US009161146B2

(12) United States Patent
Hu et al.

(10) Patent No.: US 9,161,146 B2
(45) Date of Patent: Oct. 13, 2015

(54) DEVICE AND METHOD FOR DIAGNOSING AUDIO CIRCUITRY

(75) Inventors: Nan Hu, Guangdong Province (CN); Ziqiang Zuo, Guangdong Province (CN); Wei Jiang, Guangdong Province (CN)

(73) Assignee: ZTE CORPORATION, Shenzhen, Guangdong Province (CN)

( * ) Notice: Subject to any disclaimer, the term of this patent is extended or adjusted under 35 U.S.C. 154(b) by 253 days.

(21) Appl. No.: 13/259,722

(22) PCT Filed: Sep. 15, 2010

(86) PCT No.: PCT/CN2010/076971

§ 371 (c)(1),
(2), (4) Date: Apr. 19, 2012

(87) PCT Pub. No.: WO2011/160342

PCT Pub. Date: Dec. 29, 2011

(65) Prior Publication Data

US 2013/0108062 A1 May 2, 2013

(30) Foreign Application Priority Data

Jun. 23, 2010 (CN) ..... 2010 1 0217338

(51) Int. Cl.
*H04R 29/00* (2006.01)
*H04R 3/00* (2006.01)
*H04R 1/10* (2006.01)

(52) U.S. Cl.
CPC ..... *H04R 29/004* (2013.01); *H04R 1/1091* (2013.01); *H04R 29/006* (2013.01); *H04R 2201/029* (2013.01); *H04R 2430/01* (2013.01); *H04R 2499/11* (2013.01)

(58) Field of Classification Search
CPC .... H04R 29/00; H04R 29/004; H04R 29/005; H04R 29/006; H04R 2499/11; H04R 31/00; H04R 2201/029; H04R 25/30; H04M 1/24
USPC ..... 381/58, 111, 122; 73/584, 645–648; 324/537, 754.01, 754.08, 754.21, 324/605–607, 612, 616
See application file for complete search history.

(56) References Cited

U.S. PATENT DOCUMENTS 4,346,268 A * 8/1982 Geerling ..... 381/58
4,782,284 A * 11/1988 Adams et al. ..... 324/76.22

(Continued)

FOREIGN PATENT DOCUMENTS

CN 1838839 A 9/2006
CN 101051456 A 10/2007

(Continued)

OTHER PUBLICATIONS

International Search Report dated Mar. 31, 2011, issued in corresponding International Application No. PCT/CN2010/076971.

(Continued)

*Primary Examiner* — Davetta W Goins
*Assistant Examiner* — Daniel Sellers
(74) *Attorney, Agent, or Firm* — Scully, Scott, Murphy & Presser, P.C.

(57) ABSTRACT

The present invention provides a device and method for diagnosing an audio circuitry, which is applied to a mobile terminal and its earphone. Both of the mobile terminal and its earphone include: a MIC circuit and a sounding circuit, wherein, this device includes: a MIC Circuit Diagnosis Module and a Sounding Circuit Diagnosis Module; A MIC Circuit Diagnosis Module is used for obtaining an amplitude and frequency of a sine wave signal sampled by the MIC circuit, determining whether the MIC circuit is qualified or not according to the amplitude and frequency and outputting the sine wave signal. A Sounding Circuit Diagnosis Module includes: a converter plate with a MIC circuit and a processor; the converter plate is used for sampling an analog signal output by the sounding circuit, converting the analog signal into a digital signal and sending it to a processor; and the processor is used for analyzing and processing the amplitude and frequency of the digital signal and determining whether the sounding circuit is qualified or not. According to the technical scheme provided by the present invention, the quality problem existing in the audio circuitry module of the mobile terminal can be solved, so as to reduce users' complaints and improve the customer satisfaction.

9 Claims, 4 Drawing Sheets

(56) References Cited

U.S. PATENT DOCUMENTS

| | | | | |
|---|---|---|---|---|
| 4,788,708 | A | 11/1988 | Hendrix | |
| 5,581,621 | A * | 12/1996 | Koyama et al. | 381/103 |
| 5,943,649 | A * | 8/1999 | Fado et al. | 704/270 |
| 6,925,185 | B2 * | 8/2005 | Chung | 381/58 |
| 7,548,625 | B2 * | 6/2009 | Dorfman et al. | 381/58 |
| 7,593,781 | B1 * | 9/2009 | Rhea | 700/94 |
| 8,144,884 | B2 * | 3/2012 | Van Den Heuvel et al. | 381/60 |
| 8,630,423 | B1 * | 1/2014 | Elliott | 381/58 |
| 2009/0290729 | A1 * | 11/2009 | Zhang | 381/122 |

FOREIGN PATENT DOCUMENTS

| | | | |
|---|---|---|---|
| CN | 101115329 | A | 1/2008 |
| CN | 101426167 | A | 5/2009 |
| JP | 2009003162 | A | 8/2009 |

OTHER PUBLICATIONS

Supplementary European Search Report mailed Dec. 5, 2013 in Application No. EP 10 85 3481.

* cited by examiner

DEVICE AND METHOD FOR DIAGNOSING AUDIO CIRCUITRY

FIELD OF THE INVENTION

The present invention relates to the communication field, and particularly a device and method for diagnosing an audio circuitry.

BACKGROUND OF THE INVENTION

With the cost of a mobile terminal (e.g., a mobile phone) continuously reducing and shipments continuously increasing, different mobile phones have certain differences in audio circuitry modules, and very few mobile phones even have serious quality problems, therefore, detection and calibration need to be conducted in production line. The following two kinds of problems mainly exist:

The first kind of problems is that hardware or a component itself has evident problems. For example, a receiver fails to sound and always has cooing noises; the volume of a microphone (hereinafter referred as to MIC) is so low that the user can not hear it clearly. Distributing such phones to users will result in users' complaints. Therefore, in the production line, the mobile phones with such problems should be directly rejected or their components should be directly replaced.

The second kind of problems is due to the fluctuation of components themselves, resulting in that the setting of some parameters in some phones are not appropriate, therefore their audio frequency parameters need to be updated. For example, due to a component, the sensitivity of MIC has a difference of ±3 dB, and the total difference will be 6 dB. If the uplink analog gain is not changed, the uplink volume will be too high or too low depending on individual difference, and if it is too high, environmental impacts force a user to speak with a loud voice, and the uplink cracked voice will be evident, thus reducing the user's experience.

To solve such problems, the audio frequency testing item needs to be added in the production test so as to reject mobile phones with the first kind of problems and conduct automatic parameter modification to mobile phones with the second kind of problems.

SUMMARY OF THE INVENTION

Considering the problem that in related technologies audio circuitry modules of mobile terminals have quality problems that result in users' complaints, the present invention provides a method and device for diagnosing an audio circuitry of a mobile terminal to solve the foregoing problem.

According to an aspect of the present invention, a device for diagnosing an audio circuitry is provided.

The audio circuitry diagnosis device according to the present invention is applied to a mobile terminal and its earphone. Both of the mobile terminal and its earphone include: a MIC circuit and a sounding circuit, wherein, the audio circuitry diagnosis device includes: a MIC Circuit Diagnosis Module and a Sounding Circuit Diagnosis Module; A MIC Circuit Diagnosis Module is used for obtaining an amplitude and frequency of a sine wave signal sampled by the MIC circuit, determining whether the MIC circuit is qualified or not according to the amplitude and frequency and outputting the sine wave signal. A Sounding Circuit Diagnosis Module includes: a converter plate with a MIC circuit and a processor; the converter plate is used for sampling an analog signal output by the sounding circuit, converting the analog signal into a digital signal and sending it to a processor; and the processor is used for analyzing and processing the amplitude and frequency of the digital signal and determining whether the sounding circuit is qualified or not.

According to an aspect of the present invention, a method for diagnosing an audio circuitry is provided.

The audio circuitry diagnosis method according to the present invention is applied to a mobile terminal and its earphone. Both of the mobile terminal and its earphone include: a MIC circuit and a sounding circuit, wherein, this method comprises: obtaining an amplitude and frequency of a sine wave signal sampled by the MIC circuit; determining whether the MIC circuit is qualified or not according to the amplitude and frequency and outputting the sine wave signal; amplifying the amplitude of the sine wave signal and sending it to the sounding circuit; after an output signal of the sounding circuit is sampled, analyzing and processing the amplitude and frequency of the output signal and determining whether the sounding circuit is qualified or not.

According to the present invention, a device for diagnosing an audio circuitry is provided, mainly including: a MIC Circuit Diagnosis Module and a Sounding Circuit Diagnosis Module. By utilizing this device to diagnose the quality of the audio circuitry modules (MIC circuit and sounding circuit) of the mobile terminal, the existing quality problems in the audio circuitry modules of the mobile terminal can be solved, thus reducing users' complaints and improving the customers' satisfaction.

BRIEF DESCRIPTION OF THE DRAWINGS

The drawings illustrated herein are used to provide a further understanding of the present invention, and shall constitute one part of this application; the schematic embodiments of the present invention and their illustration are used to explain the present invention and shall not be the improper limitations of the present invention. In the drawings.

DETAILED DESCRIPTION OF THE PREFERRED EMBODIMENTS

The present invention will be illustrated in detail with reference to the drawings and in conjunction with embodiments hereinafter. It needs to be noted that, in case of no conflicts, the embodiments of this application and their characteristics can be combined with each other.

Figure 1:
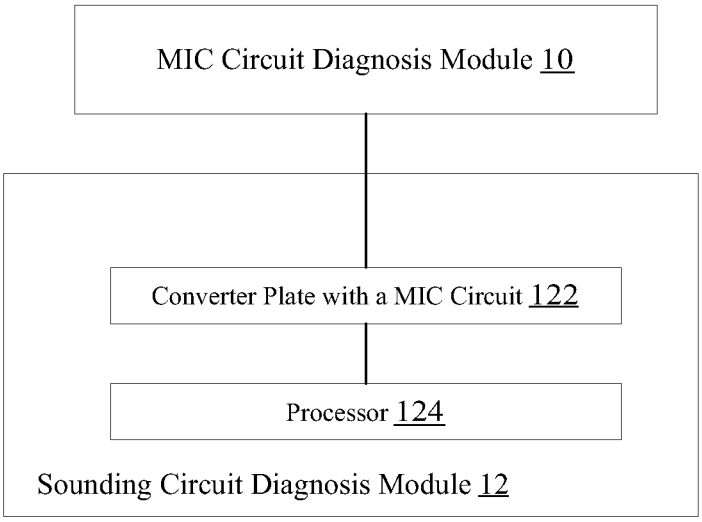
FIG. 1 is a structure diagram of the audio circuitry diagnosis device according to the embodiment of the present invention.

FIG. 1 is a structure diagram of the audio circuitry diagnosis device according to the embodiment of present invention. As shown in FIG. 1, the audio circuitry diagnosis device according to the embodiment of the present invention includes: MIC Circuit Diagnosis Module 10 and Sounding Circuit Diagnosis Module 12. Wherein, Sounding Circuit Diagnosis Module 12 can further include: Converter Plate 122 with a MIC circuit and Processor 124.

MIC Circuit Diagnosis Module 10, is used for obtaining an amplitude and frequency of a sine wave signal sampled by the MIC circuit, determining whether the MIC circuit is qualified or not according to the amplitude and frequency and outputting the sine wave signal.

Converter Plate 122 is used for sampling an analog signal output by the sounding circuit, converting the analog signal into a digital signal and sending it to the processor;

Processor 124 is used for analyzing and processing the amplitude and frequency of the received signal and determining whether the sounding circuit is qualified or not.

With the foregoing device, the audio circuitry can be completely diagnosed to eliminate the mobile terminals with hardware or component problems, avoiding users' complaints and improving customers' satisfaction.

Wherein, the foregoing MIC Circuit Diagnosis Module 10 can be at least one of the following:

A mobile terminal's MIC Circuit Diagnosis Module is used for obtaining amplitude and frequency of a sine wave signal sampled by the MIC circuit, wherein, the sine signal input into the MIC circuit is an analog signal from the interior loudspeaker of a sound extinction enclosure.

An earphone's MIC Circuit Diagnosis Module is used for obtaining an amplitude and frequency of a sine wave signal sampled by the MIC circuit, wherein, the sine wave signal input into the earphone MIC circuit is an electric signal from a processor.

In this case, the foregoing Sounding Circuit Diagnosis Module 12 can be at least one of the following:

a Mobile Terminal Receiver Circuit Diagnosis Module, a Speaker Circuit Diagnosis Module and an Earphone Receiver Circuit Diagnosis Module.

Preferably, a MIC Circuit Diagnosis Module is also used for determining whether the MIC circuit is qualified or not when the ratio of the amplitude and the predetermined standard value is less than the first threshold value and the distortion of the frequency does not occur.

Preferably, during diagnosing an audio circuitry, the foregoing MIC Circuit Diagnosis Module is also used for adjusting the uplink gain of the MIC circuit until the ratio is less than the first threshold value when the ratio of the amplitude and the predetermined standard value is greater than the first threshold value and less than the second threshold value, wherein, the number of times of adjusting the uplink gain of the MIC circuit cannot exceed the predetermined value.

Preferably, during diagnosing an audio circuitry, the foregoing MIC Circuit Diagnosis Module is also used for determining that the MIC circuit is not qualified when the ratio of the amplitude to predetermined standard value is greater than the second threshold value.

In the preferred embodiments, a sine wave signal of a fixed frequency can be output by using a computer via a mini-type power amplifier and a loudspeaker, after the MIC circuit of a mobile phone having sampled this sine save signal, it transforms the signal into a digital one via an analog base band (hereinafter referred as to ABB) chip and sends the digital signal to a digital base band (hereinafter referred as to DBB) chip, and therefore MIC Circuit Diagnosis Module 10 determines the positions of the sine wave's highest point and lowest point via a sine wave synchronization algorithm so as to estimate its amplitude scope. If the difference between the amplitude scope and a measured ratio scope of a standard mobile phone is small (e.g., less than 1.5 dB), this mobile phone is considered to have no quality problem and a prompting of "OK" will be output via a USB interface; If the difference between the amplitude scope and a measured ratio scope of a standard mobile phone is large (e.g., greater than 6 dB), this mobile phone is considered to have irreparable problems and a prompting of "ERR" will be output via a USB interface, which means that some component or hardware circuits may have problems. If the difference between the amplitude scope and a measured scope of a standard mobile phone is between 1.5 dB to 6 dB, improvement will be conducted by adjusting an uplink gain in ABB, and the modification can be iteratively done altogether for predetermined number of times (e.g., 3~5 times), if successful, a prompting of "OK" will be output via a USB interface, otherwise, error information will be sent back. Whether the frequency distortion exists or not is determined by a period calculated out by a sine wave signal synchronization algorithm and the result will be output to the computer via the USB interface.

Similarly, the fundamental principle for diagnosing an earphone MIC circuit and a mobile phone MIC circuit is the same. However, a sine wave signal input to an earphone MIC circuit is the one with a fixed frequency from a processor (e.g., PC machine)

In the preferred embodiments, in the condition that the earphone MIC circuit diagnosis has been completed and no problem exists, this input sine wave can also be amplified to a fixed amplitude with an amplitude amplification circuit and output from the mobile phone receiver, and sampled to the computer via Converter Circuit Plate 122 with a MIC circuit (it needs to be noted that a fixed distance and direction should be kept between the converter circuit plate and the receiver). Processor 124 (e.g., a computer) will calculate its amplitude scope and test whether it has clipping or not via conducting FFT. If the calculated amplitude cannot meet the requirement, the downlink gain can be modified via AT command for proper adjustment. In general, it is rare that mobile phones have difference in the receiver sensitivity; the main problem that the receiver has evident clipping and noises can be generally solved by replacing components.

Similarly, the fundamental principle for diagnosing a speaker circuit and a mobile phone receiver circuit is essentially the same, but the location of the converter circuit plate with MIC needs to be changed and kept consistent with that of the speaker. The fundamental of diagnosing an earphone receiver circuit and a mobile phone receiver circuit is also consistent, and the pathway which inputs the sine wave signal can be the earphone MIC circuit as well as the mobile phone MIC circuit.

According to foregoing preferred technical scheme, not only the mobile terminal with problems in hardware and component can be eliminated, but also those with incorrect audio frequency parameters instead of hardware or component problems can be calibrated to be qualified so as to greatly reduce the production cost.

Figure 2:
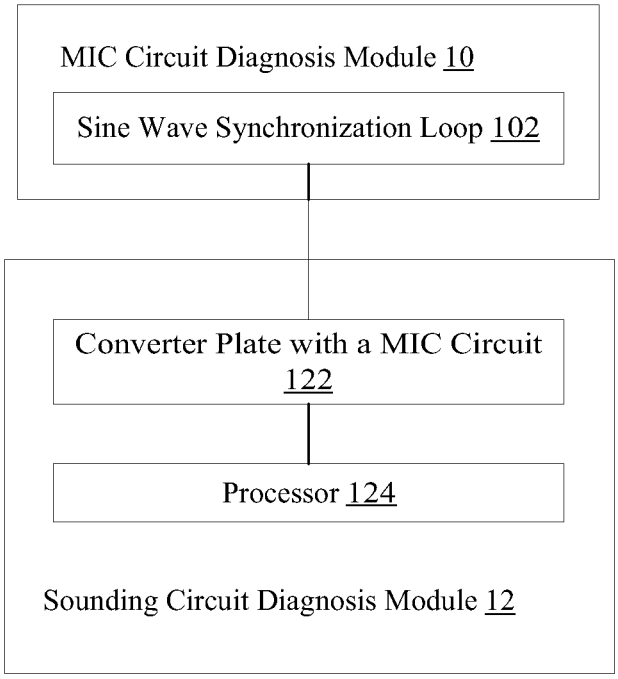
FIG. 2 is a structure diagram of the audio circuitry diagnosis device according to the preferred embodiment of the present invention.

Preferably, as shown in FIG. 2, MIC Circuit Diagnosis Module 10 can further include: Sine Wave Synchronization Loop 102.

Preferably, Sine Wave Synchronization Loop 102 is used for recovering the frequency and phase of the sine wave signal from the received signal with an interpolating algorithm of a variable frequency and taking sample when the signal eye pattern is the largest in order to obtain the amplitude of the sine wave signal.

In the preferred embodiment, MIC Circuit Diagnosis Module 10 adopts a sine wave synchronization algorithm circuit and can adjust its step length according to the frequency of the input signal via AT command so as to accelerate a convergence rate. In general conditions, the convergence can be conducted in 20 sine wave period to find out its amplitude value, therefore, the signals with different frequencies can be adopted for testing.

Figure 3:
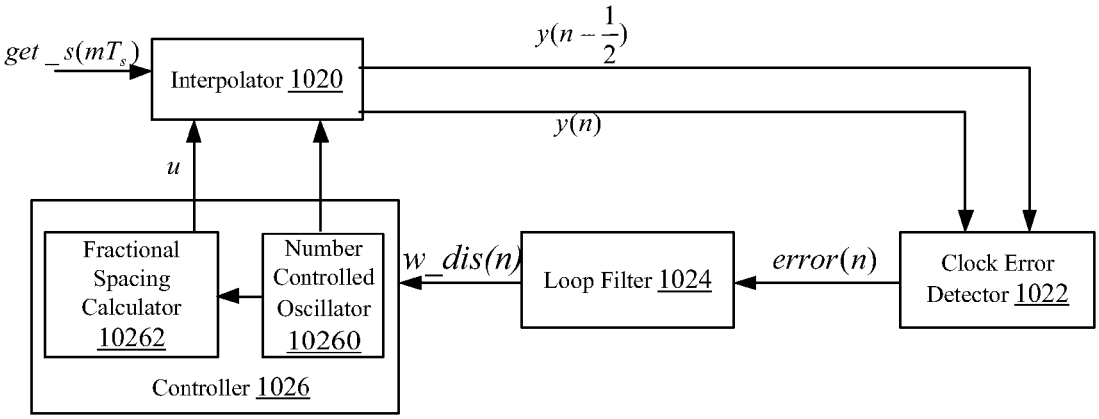
FIG. 3 is a detailed structure diagram of the Sine Wave Synchronization Loop according to the preferred embodiment of the present invention.

FIG. 3 is a detailed structure diagram of the Sine Wave Synchronization Loop according to the preferred embodiment of the present invention. As shown in FIG. 3, forgoing Sine Wave Synchronization Loop 102 can further include:

Interpolator 1020 is used for extracting two data from each period of the signal received from this Sine Wave Synchronization Loop and sending them to Clock Error Detector 1022.

Clock Error Detector 1022 is used for extracting errors according to three successive data input by the interpolator and sending them to Loop Filter 1024.

Loop Filter 1024 is used for determining a step length updating amount of a Number Controlled Oscillator with foregoing errors.

Controller 1026 includes: Number Controlled Oscillator (hereinafter referred to as NCO) 10260 and Fractional Spacing Calculator 10262.

Number Controlled Oscillator 1028 is used for conducting superposition calculation to obtain the step length with the updating data amount and conducting subtraction calculation overflow to generate a clock so as to obtain an interpolation base point through the step length Fractional Spacing Calculator 1030 is used for determining the fractional spacing between the optimum interpolating moment and the base point through interpolating base point and similar triangle principles and feedback it to the interpolator.

Forgoing each component will be described in detail hereinafter.

(1) Interpolator 1020

An interpolator generally adopts a Farrow structure, which can further be divided into a linear structure, a piecewise parabolic structure, a cubic Farrow structure and a cubic direct structure. Wherein, the linear structure interpolator is the simplest and the filtering performance of the cubic types is the best.

However, an improvement of performance is generally at a cost of resource consumption. Considering to achieve an algorithm in the interior of a mobile phone, an interpolator can generally adopt four-point piecewise parabolic interpolation filter with the parameter a=0.5, for its tap coefficient can be decomposed into 0.5 or 1 and its software implementation only uses quadratic multiplier while others are addition and displacement operations, and the performance of the piecewise parabolic interpolation filter can mainly meet the requirement of accuracy. The expression formula is as follows:

$$farrow1 = 0.5x(m_k+2) - 0.5x(m_k+1) - 0.5x(m_k) + 0.5x(m_k-1)$$
$$= \frac{1}{2}\{[x(m_k+2)+x(m_k-1)] - [x(m_k+1)+x(m_k)]\}$$
$$farrow2 = 1.5x(m_k+1) - 0.5x(m_k+2) - 0.5x(m_k) - 0.5x(m_k-1)$$
$$farrow3 = x(m_k)$$
$$y(n) = (farrow1 \times u_k + farrow2) \times u_k + farrow3$$

Wherein $m_k$ is the interpolating base point, indicating the conducting interpolation at this moment; $u_k$ is the fractional spacing between the optimum interpolating moment and the base point. The value of $m_k$ and $u_k$ are generated and modified by the controller.

(2) Clock Error Detector 1022

After the loop is locked, Interpolator 1022 extracts two data from the data in a wave form period and delivers them to Clock Error Detector 1022 to extract errors. The formula of the clock error extraction is as follows:

$$error = y_{2x}(y_3 - y_1)$$

Wherein, y1, y2, y3 are three successively interpolating output data.

In each period, two points should be sampled.

If the loop has been converged, one of the two points $y_1$ (or $y_3$) is the optimum viewpoint (i.e. the highest or lowest point of the sine wave, and its value is the amplitude of the sine wave), and another point $y_2$ is the sampling point between the two optimum viewpoints, which should be fluctuating around the fixed amplitude at the moment, in this way, the average value of the errors is zero and the loop converges; when the loop estimated sine wave period is shorter than the actual one, the average value of the errors is negative, which makes the step length updating amount w _dis(n) generated by the Loop Filtering be negative and the interpolation period generated by the loop be shorter in the next calculation; on the contrary, when the loop estimated sine wave period is longer than the actual one, the interpolation period generated by the loop will be longer in next calculation. Thus, acquiring and tracking the sine wave period is achieved. In addition, when the phase of the acquired sample is advanced or delayed, the step length w_dis(n) will be caused to change until the frequency and phase are consistent in the end.

(3) Loop Filter 1024

Loop Filter 1024 adopts an ideal first-order integration filter, utilizing clock an error to generate a step length updating amount of the Number Controlled Oscillator, which is transformed to a Timing Synchronization Control Module for use, and the time domain recursion equation of the Loop Filter is:

$$w_dis(n) = w_dis(n-1) + c_1 * [error(n) - error(n-1)] + c_2 * error(n)$$

Wherein, $c_1$, $c_2$, can be calculated out via some second-order filter formulas and this value needs to be set according to the convergent rate and convergent stability.

(4) Controller 1026

A controller is a circuit specially used for generating sine wave clock signals and providing an interpolating fractional spacing. Wherein, the function of Number Controlled Oscillator 10260 is to conduct subtraction overflow to generate a clock, that is, the interpolating base point $m_k$; the function of Fractional Spacing Calculator 10262 is to calculate out $u_k$ and provide it to the interpolator. Before conducting the above operation, the step length should be calculated, and the formula is as follows:

$$w(n+1) = w(n) + w_dis(n)$$

The Number Controlled Oscillator is an accumulator (or subtractor), whose difference equation is:

$$\eta(m+1) = [\eta(m) - w(n)] \bmod 1$$

In the working process of the Number Controlled Oscillator, the working period of the Number Controlled Oscillator is the sampling period $T_s$, and the period of the interpolator is $T_i$ (for interpolating two points in a sine wave period, interpolator period is half of the sine wave period $T_s$). The step length is $$w(m) \approx \frac{T_s}{T_i}$$

after converging.

Figure 4:
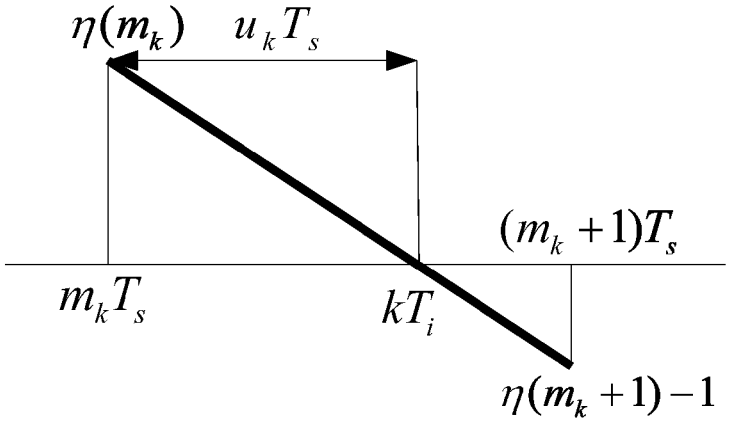
FIG. 4 is a schematic diagram of calculating fractional spacing according to the embodiment of the present invention.

Supposing η(1)=0.9 and the frequency in a sine wave is 1 KHz, and a sampling frequency is 8 KHz, that is, sampling 8 points in a period, thus $T_i$=½T, $$T_s = \frac{1}{8}T,\ w(1) = \frac{T_s}{T} \times \frac{T}{T_i} = 0.25,$$

thus obtaining that η(2)=[η(1)−w(1)]mod1=0.65, η(3)=[η(2)−w(1)]mod1=0.4, η(4)=[η(3)−w(1)]mod1=0.15 η(5)=[η(4)−w(1)]mod1=(0.15−025) mod1=0.9. It can be seen that η overflows from $4^{th}$ point to $5^{th}$ point, therefore $4^{th}$ point is a base point, and the interpolating calculation is conducted according to the adjacent $3^{th}$, $4^{th}$, $5^{th}$, $6^{th}$ points. With reference to FIG. 4 in detail and the similar triangle principles, obtaining:

$$\frac{u_k T_s}{\eta(m_k)} = \frac{(1-u_k)T_s}{1-\eta(m_k+1)}$$

It can be worked out that:

$$u_k = \frac{\eta(m_k)}{1-\eta(m_k+1)+\eta(m_k)} = \frac{\eta(m_k)}{w(k)}$$

Wherein, the step length w(k) will change only after a sine wave period, and division operation design is very complex, with the general frequency roughly known. Thus w(k) can generally be determined by the roughly adopted points in the interpolator period, for example, the foregoing formula can set w(k)=0.25, then $u_k$=4η($m_k$) , wherein this step length value can be input to the mobile phone by using AT command via the USB interface according to the frequency of the input signal to adjust its step length so as to converge faster.

After being sampled by a MIC circuit, the highest point and lowest point, that is, the amplitude information can be extracted out of a sine wave via such a loop. Through the amplitude information, it can be determined whether the sensitivity of the MIC and the uplink analog gain are appropriate, whether they need adjusting, or whether reporting the unlink gain calibration failure directly. By checking the values of several groups of $u_k$, it can be determined whether harmonics or distortion exists, and if any distortion or clipping exists, $u_k$ will fluctuate greatly.

In addition, if the frequency of the input sine wave is different, it is better to set the initial value of $u_k$ via AT command, thus the convergence rate can be accelerated. Wherein, the clock T that generating data should be $2f_s/f_0$ with fs indicating sampling frequency and $f_0$ indicating sine wave frequency; the value can also be used to determine whether any distortion or clipping exists.

Figure 5:
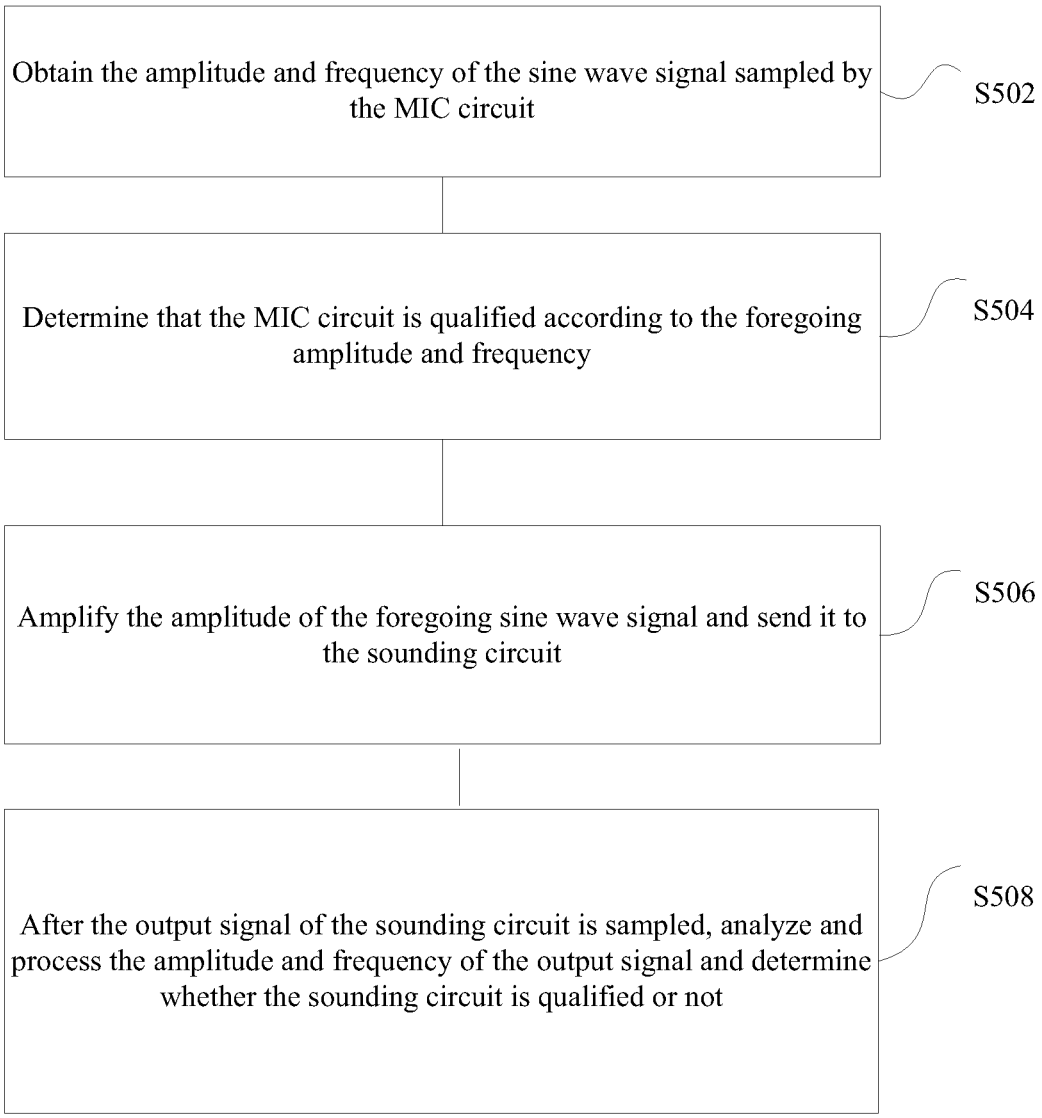
FIG. 5 is a flow chart of the audio circuitry diagnosis method according to the embodiment of the present invention.

FIG. 5 is a flow chart of the audio circuitry diagnosis method according to the embodiment of the present invention, as shown in FIG. 5, the audio circuitry diagnosis method according to the embodiment of the present invention comprises the following steps:

Step S502: Obtain an amplitude and frequency of a sine wave signal sampled by a MIC circuit.

Step S504: Determine the MIC circuit is qualified according to the foregoing amplitude and frequency.

Step S506: Amplify the amplitude of the forgoing sine wave signal and send it to a sounding circuit.

Step S508: Analyze and process the amplitude and frequency of the output signal after the output signal of the sounding circuit is sampled, and determine whether the sounding circuit is qualified or not.

By utilizing this scheme, the audio circuitry can be diagnosed completely with the simplest device, so as to greatly eliminate the hardware and component problems of the mobile phone devices and reduce users' complaints.

Preferably, determining that the MIC circuit is qualified according to the foregoing amplitude and the foregoing frequency can comprise the following operations: determining that the MIC circuit is qualified when the ratio of the amplitude and the predetermined standard value is less than the first threshold value and the distortion of the frequency does not occur.

Preferably, determining that the MIC circuit is qualified according to the foregoing amplitude and the foregoing frequency can also comprise the following operations: adjusting the uplink gain of the MIC circuit until the foregoing ratio is less than the first threshold value when the ratio of the amplitude and the predetermined standard value is greater than the first threshold value and less than the second threshold value, wherein, the number of times for adjusting the uplink gain of the MIC circuit cannot exceed the predetermined value.

Preferably, determining that the MIC circuit is qualified according to the foregoing amplitude and the foregoing frequency can also comprise the following operations: determining that the MIC circuit is not qualified when the ratio of the amplitude and the predetermined standard value is greater than the second threshold value.

Preferably, Step S502 can further comprise the following operations:

(1) Adopting an interpolating algorithm of a variable frequency to recover the frequency and phase of the sine wave signal from the received signal;

(2) Taking samples when the signal eye pattern is the largest in order to obtain the amplitude of the sine wave signal.

After sampling the sine wave signal, the obtained sample may not be the highest point, that is, the amplitude value cannot be directly determined; however, with an algorithm, the amplitude of the input signal can be determined through the Sine Wave Synchronization Loop. Adopting this algorithm enables determining the corresponding amplitude values within 20 sine wave signal periods; with a relatively low speed and less amount of computation, AT command of the USB interface can be used to control step length modification, so as to achieve the measurement of multiple frequency points.

Therefore, the function mainly completed by the Sine Wave Synchronization Loop is to recover the frequency and phase of the sine wave clock from the received signal and make it take samples when the signal eye pattern is the largest, and support the interpolation of a variable frequency. The detailed structure of the Sine Wave Synchronization Loop can be seen in FIG. 3 and it is not repeated herein.

As mentioned above, the signal of different frequencies can be used for testing. For example, diagnosis can conducted from mobile phone MIC pathway to earphone receiver pathway, from earphone MIC pathway to mobile phone receiver pathway and from earphone MIC pathway to speaker pathway; the foregoing each pairing pathway has only one component sounding in a sound extinction enclosure at each moment, which can greatly avoid the mutual interference among sounds. The preferred diagnosis process from mobile phone MIC pathway to earphone receiver pathway will be described in conjunction with FIG. 6 hereinafter.

Figure 6:
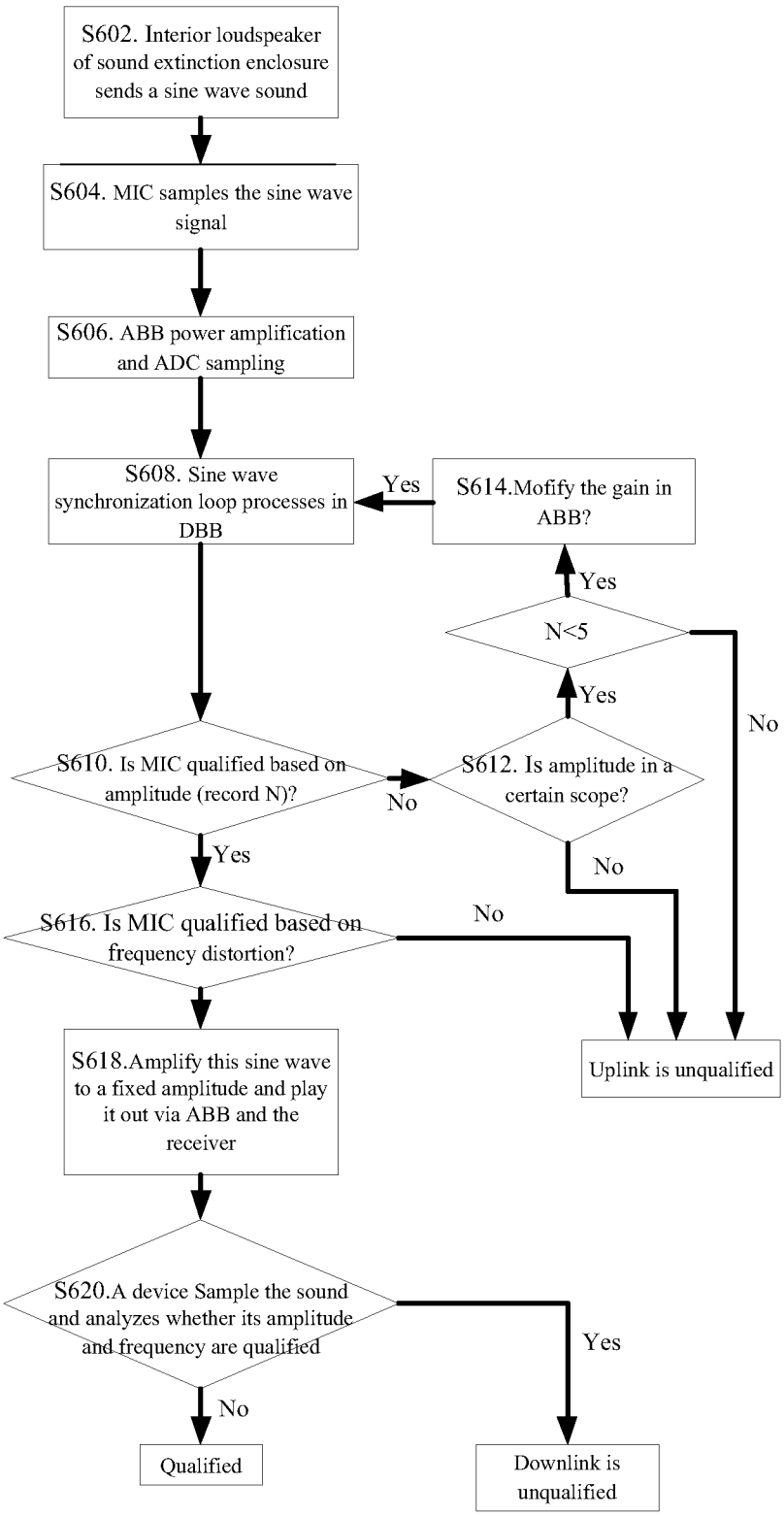
FIG. 6 is a flow chart of the audio circuitry diagnosis method according to the preferred embodiment of the present invention.

FIG. 6 is a flow chart of the audio circuitry diagnosis method according to the preferred embodiment of the present invention. As shown in FIG. 6, this audio circuitry diagnosis method can be divided into two parts on the whole: the diagnosis of the mobile phone MIC circuit and the diagnosis of the mobile phone receiver circuit. This method mainly comprises the following operations:

Step S602: Fix the mobile phone in the sound extinction enclosure, connect the USB data line, and use a computer to input a sine wave signal with a fixed frequency via a mini-type power amplifier and a loudspeaker;

Step S604: The mobile phone MIC circuit samples this sine wave;

Step S606: Transform the sine wave signal into a digital signal via ABB and input it to DBB chip;

Step S608: Find out its highest and lowest point via a sine wave synchronization algorithm in the DBB chip so as to estimate its amplitude scope.

Step S610: If the difference between the amplitude scope and a measured ratio scope of a standard mobile phone is small (e.g., less than 1.5 dB), this mobile phone is considered to have no quality problem and a prompting of "OK" will be output via a USB interface;

Step S612: Determine whether the amplitude scope is in a certain scope, for example, if the difference between the amplitude scope and a measured ratio scope of a standard mobile phone is large (e.g., greater than 6 dB), this mobile phone is considered to have irreparable problems and a prompting of "ERR" will be output via a USB interface, and some component or hardware circuit may have problems by now; if the difference between the amplitude scope and a measured scope of a standard mobile phone is between 1.5 dB to 6 dB, execute Step S614;

Step S614: Perform improvement by adjusting the uplink gain in ABB and the modification can be iteratively done totally 3~5 times, if successful, a prompting of "OK" will be output via a USB interface, otherwise, send back the error information.

Step S616: Determine whether frequency distortion exists or not by the period calculated out through the sine wave signal synchronization algorithm and output the result to a computer via the USB interface.

Step S618: If the MIC circuit diagnosis is completed and the MIC circuit has no problem, amplify the input sine wave to fixed amplitude and transform it out from the receiver;

Step S620: Sample it to a computer via a converter circuit plate with a MIC circuit (it should be noted that a fixed distance and direction should be kept between the converter circuit plate and the receiver), calculate its amplitude scope via the computer and conduct TFT test to see whether it has clipping or not. If the amplitude worked out cannot meet the requirement, modify the downlink gain via AT command to for proper adjustment. In general, it is rare that mobile phones have difference in the receiver sensitivity, and the main problem is that the receiver has apparent clipping and noises, which can be generally solved via replacing the component.

In conclusion, with the help of the foregoing embodiments provided by the present invention, adding the audio circuitry diagnosis device in the production test and using a simple device to diagnose the audio circuitry completely can eliminate the hardware and component problems in the mobile phone device to the great extent, reducing the users' complaints. In addition, the sine wave synchronization algorithm can be used to quickly and accurately find out the amplitude of the input signal with small accumulating amount, high stability and little mobile phone resource occupied, and can be easily achieved.

Apparently, those skilled in this art should understand, each foregoing module or each step of the present invention can be realized with general computing devices; they can be centralized on a single computing device or distributed in the network consisting of several computing devices; selectively, they can be realized through program codes that can be executed by computing devices so that they can be stored in storage devices and executed by computing devices, or they can be manufactures as each integrated circuit module respectively, or several modules or step lengths of them can be manufactured as a single integrated circuit. In this way, the present invention is not limited to any specific combination of hardware and software.

The foregoing description is only preferred embodiments of the present invention and shall not be limitations to the present invention. Those skilled in the art should understand that the present invention can have various modifications and alternations. Any modification, equivalent replacement or improvement based on the spirits and principles of the present invention shall belong to the protection scope of the present invention.

What is claimed is:

1. A device for diagnosing an audio circuitry, applied to a mobile terminal and its earphone, both of the mobile terminal and its earphone comprising a microphone (MIC) circuit and a sounding circuit, wherein the device for diagnosing an audio circuitry comprises:

a MIC Circuit Diagnosis Module; and a Sounding Circuit Diagnosis Module;

wherein the MIC Circuit Detection Module is configured for obtaining an amplitude and frequency of a sine wave signal sampled by the MIC circuit, determining whether the MIC circuit is qualified or not according to the amplitude and the frequency and outputting the sine wave signal;

the Sounding Circuit Diagnosis Module comprises a converter plate with a MIC circuit and a processor;

the converter plate is configured for sampling an analog signal output by the sounding circuit, converting the analog signal into a digital signal and sending it to the processor; and the processor is configured for analyzing and processing the amplitude and frequency of the digital signal and determining whether the sounding circuit is qualified or not; and wherein the MIC Circuit Diagnosis Module comprises a Sine Wave Synchronization Loop, configured to adopt an interpolating arithmetic of a variable frequency to recover the frequency and phase of the sine wave signal from the received signal and configured to take samples when the signal eye pattern is the largest in order to obtain the amplitude of the sine wave signal.

2. The device according to claim 1, wherein the MIC Circuit Detection Module is also configured for determining the MIC circuit is qualified when the ratio of the amplitude and predetermined standard value is less than a first threshold value and a distortion of the frequency does not occur.

3. The device according to claim 2, wherein the MIC Circuit Detection Module is also configured for adjusting the uplink gain of the MIC circuit until the ratio is less than the first threshold value when the ratio of the amplitude and predetermined standard value is greater than the first threshold value and less than a second threshold value, wherein, the number of times for adjusting the uplink gain of the MIC circuit cannot exceed a predetermined value.

4. The device according to claim 3, wherein the MIC Circuit Detection Module is also configured for determining that the MIC circuit is not qualified when the ratio of the amplitude and the predetermined standard value is greater than the second threshold value.

5. The device according to claim 1, wherein the MIC Circuit Diagnosis Module is at least one of:

a Mobile Terminal MIC Circuit Diagnosis Module, configured for obtaining an amplitude and frequency of a sine wave signal sampled by the MIC circuit, wherein, the sine wave signal input in the MIC circuit is an analog signal from an interior loudspeaker of a sound extinction enclosure; and an Earphone MIC Circuit Diagnosis Module, configured for obtaining an amplitude and frequency of a sine wave signal sampled by the MIC circuit, wherein, the sine wave signal input in the earphone MIC circuit is an electrical signal from a processor.

6. The device according to claim 1, wherein the Sounding Circuit Diagnosis Module is at least one of: a Mobile Terminal Receiver Circuit Diagnosis Module, a Speaker Circuit Diagnosis Modules and an Earphone Receiver Circuit Diagnosis Modules.

7. The device according to claim 1, wherein the Sine Wave Synchronization Loop comprises:

an Interpolator, configured for extracting two data from each period of the signal received from the Sine Wave Synchronization Loop and sending them to a Clock Error Detector;

the Clock Error Detector, configured for extracting errors according to three successive data input by the interpolator and sending them to a Loop Filter;

the Loop Filter, configured for adopting the errors to determine an updating step length amount of a Number Controlled Oscillator; and a controller, comprising: the Loop Filter and a Fractional Spacing calculator;

wherein the Number Controlled Oscillator, configured for adopting the updating data amount to conduct superposition calculation to obtain a step length and adopting the step length to conduct subtraction calculation overflow to generate a clock so as to obtain an interpolation base point; and the Fractional Spacing Calculator, configured for determining a fractional spacing between an optimum interpolating moment and a base point by using the base point and similar triangle principles and feeding it back to the interpolator.

8. A method for diagnosing an audio circuitry, applied to a mobile terminal and its earphone, both of the mobile terminal and its earphone including a MIC circuit and sounding circuit, the method comprising:

obtaining an amplitude and frequency of a sine wave signal sampled by the MIC circuit;

determining whether the MIC circuit is qualified or nor according to the amplitude and the frequency and outputting the sine wave signal;

amplifying the amplitude of the sine wave signal and sending it to the sounding circuit; and after the output signal of the sounding circuit is sampled, analyzing and processing the amplitude and frequency of the output signal, and determining whether the sounding circuit is qualified or not;

wherein obtaining the amplitude and frequency of the sine wave signal sampled by the MIC circuit comprises:

adopting an interpolating algorithm of a variable frequency to recover a frequency and phase of the sine wave signal from the received signal; and taking samples when the signal eye pattern is the largest in order to obtain the amplitude of the sine wave signal.

9. The method according to claim 8, wherein determining whether the MIC circuit is qualified or not comprises one of:

determining whether the MIC circuit is qualified or not when a ratio of the amplitude and a predetermined standard value is less than a first threshold value and a distortion of the frequency does not occur;

adjusting an uplink gain of the MIC circuit until the ratio is less than the first threshold value when the ratio of the amplitude and the predetermined standard value is greater than the first threshold value and less than a second threshold value, wherein, the number of times of adjusting the uplink gain of the MIC circuit cannot exceed a predetermined value; when the adjustment is successful, determining that the MIC circuit detecting is qualified, otherwise, determining that the MIC circuit detecting is not qualified; and determining that the MIC circuit detecting is not qualified when the ratio of the amplitude and the predetermined standard value is greater than the second threshold value.

* * * * *